US011529652B1

(12) United States Patent
Zheng

(10) Patent No.: US 11,529,652 B1
(45) Date of Patent: Dec. 20, 2022

(54) DOUBLE VIBRATION SOURCE SQUARE OSCILLATING SIEVE

(71) Applicant: Xin Xiang San Yuan Tang Machinery Co., Ltd., Xinxiang (CN)

(72) Inventor: Quanfa Zheng, Xinxiang (CN)

(73) Assignee: XIN XIANG SAN YUAN TANG MACHINERY CO., LTD., Xinxiang (CN)

( * ) Notice: Subject to any disclaimer, the term of this patent is extended or adjusted under 35 U.S.C. 154(b) by 0 days.

(21) Appl. No.: 17/670,615

(22) Filed: Feb. 14, 2022

(30) Foreign Application Priority Data

Jun. 10, 2021 (CN) ..... 202121292852.4
Jun. 10, 2021 (CN) ..... 202121292908.6

(51) Int. Cl.
*B07B 1/36* (2006.01)
*B07B 1/28* (2006.01)

(52) U.S. Cl.
CPC ..... *B07B 1/36* (2013.01); *B07B 1/284* (2013.01); *B07B 2201/04* (2013.01)

(58) Field of Classification Search
CPC ..... B07B 1/36; B07B 1/284
See application file for complete search history.

(56) References Cited

U.S. PATENT DOCUMENTS

| | | | | |
|---|---|---|---|---|
| 9,192,962 | B2 * | 11/2015 | Schmidt | B06B 1/166 |
| 9,694,391 | B1 * | 7/2017 | Mayer | F16C 3/28 |
| 10,220,414 | B2 * | 3/2019 | Heitfeld | B07B 1/28 |
| 10,569,304 | B2 * | 2/2020 | Bellec | F16H 35/008 |
| 11,123,769 | B2 * | 9/2021 | Lunnemann | B07B 1/284 |
| 11,278,933 | B2 * | 3/2022 | Meranda | F16C 27/063 |
| 2020/0398311 | A1 * | 12/2020 | Kato | B07B 1/38 |

* cited by examiner

*Primary Examiner* — Patrick H Mackey
(74) *Attorney, Agent, or Firm* — Muncy, Geissler, Olds & Lowe, P.C.

(57) ABSTRACT

The invention discloses a double vibration source square oscillating sieve, comprising a support frame, a sieve body, connecting rods and a vibration exciter; the sieve body is slantwise provided in the support frame, the front side and back side of the sieve body are both provided with the connecting rods, and two ends of the connecting rods are connected with the upper part of the support frame and the lower part of the sieve body by a cross universal joint; the vibration exciter is fixedly provided on any position of the upper end, the lower end and the middle part of the sieve body, and the sieve body is provided with a motor which is connected with the vibration exciter by a belt; the vibration exciter comprises a fixed housing, a gear portion, first vibration excitation assemblies and second vibration excitation assemblies which are connected with the gear portion.

10 Claims, 8 Drawing Sheets

DOUBLE VIBRATION SOURCE SQUARE OSCILLATING SIEVE

BACKGROUND OF THE INVENTION

1. Field of the Invention

The invention relates to an oscillating sieve technical field, in particular to a double vibration source square oscillating sieve.

2. Description of the Related Art

The imitated artificial design principle of the oscillating sieve is a specially designed efficient sieving machine to satisfy the requirements of high production and high precision sieving, while the square oscillating sieve is a fine sieving device with relatively large sieving area and high production in the fine sieving industry.

During the actual production and use process of the square oscillating sieve, due to the single movement mode of the sieve box of the oscillating sieve in the market, the moving trajectory of material in the oscillating sieve is single and the moving trajectory of material on the screen is basically unchanged, that is, the approximately circular moving trajectory from front to back, so that the material whose size is close to about 10 meshes of screen holes is very difficult to pass through the screen, which causes the reduction of material sieving precision, the relatively low screen utilization of the oscillating sieve and the decrease of production and work efficiency, and theoretically, even though the reduction of vibration excitation force can increase sieving precision, the production and screen cleaning capacity are overall affected, so using the single moving trajectory is very hard to solve the dual contradiction.

SUMMARY OF THE INVENTION

The invention aims to solve the technical problem to overcome the shortcomings of the above technology and provide a double vibration source square oscillating sieve.

To solve the above technical problem, the technical scheme provided by the invention is a double vibration source square oscillating sieve, comprising a support frame, a sieve body, connecting rods and a vibration exciter;

the sieve body is slantwise provided in the support frame, the front side and back side of the sieve body are both provided with the connecting rods, and two ends of the connecting rods are connected with the upper part of the support frame and the lower part of the sieve body by a cross universal joint;

the vibration exciter is fixedly provided on any position of the upper end, the lower end and the middle part of the sieve body, and the sieve body is provided with a motor which is connected with the vibration exciter by a belt;

the vibration exciter comprises a fixed housing, a gear portion, first vibration excitation assemblies and second vibration excitation assemblies which are connected with the gear portion, and the fixed housing is fixedly connected with the sieve body, the fixed housing is provided with a fixed disk which is connected with the gear portion, and the gear portion is used to drive the first vibration excitation assemblies and the second vibration excitation assemblies to rotate synchronously and reversely.

As the improvement, the first vibration excitation assemblies comprise a first rotating shaft and a first flail block only connected with one end of the first rotating shaft, the second vibration excitation assemblies comprise a second rotating shaft and a second flail block only connected with the end of the second rotating shaft which is away from the first flail block, and clump weights are provided on both the first flail block and the second flail block.

As the improvement, the first rotating shaft and the second rotating shaft are parallel and provided with clearance.

As the improvement, rotating axes of the first rotating shaft and the second rotating shaft are both provided vertically.

As the improvement, the gear portion comprises a first gear sleeved on the first rotating shaft and a second gear sleeved on the second rotating shaft, and the second gear is meshed with the first gear.

As the improvement, the gear portion also comprises a gear case, the first rotating shaft and the second rotating shaft both penetrate the gear case and they are connected with the gear case by bearing assemblies, and the fixed disk is fixedly connected with the outside of the gear case.

As the improvement, one end of the first rotating shaft which is away from the second flail block is provided with a pulley, and the pulley is connected with the motor by the belt.

As the improvement, the interior upper part of the sieve body is provided with screen assemblies I, and the interior lower part of the sieve body is provided with screen assemblies II, the number of the screen assemblies I is not less than 2, and the number of the screen assemblies I and the screen assemblies II is equal.

The advantages of the invention compared with the current technology are as follows:

1. a flail block is provided on one end of both the first rotating shaft and the second rotating shaft, and the two flail blocks are provided on different ends, so on one hand the space is saved, on the other hand eccentric distance of flail blocks is no longer limited by distance between two rotating shafts, with large adjustable space; in the meantime, during the use process, force is exerted on two ends of the gear portion and the exerted force is more uniform, which extends service life.

2. double vibration source setting can change the moving trajectory of the square oscillating sieve, solve the problem where the moving trajectory of material in the oscillating sieve is single and the moving trajectory of material on the screen is basically unchanged, increase the sieving precision, the overall production and the production efficiency and facilitate the screen cleaning.

As shown in the figures: 1. the support frame, 2. the sieve body, 3. the connecting rods, 4. the vibration exciter, 5. the screen assemblies I, 6. the screen assemblies II, 7. the motor, 8. the fixed housing, 9. the fixed disk, 10. the first rotating shaft, 11. the first flail block, 12. the second rotating shaft, 13. the second flail block, 14. the clump weights, 15. the first gear, 16. the second gear, 17. the gear case, 18. the pulley.

DESCRIPTION OF EMBODIMENTS

A further detailed description of a double vibration source square oscillating sieve in the invention is given below in combination with attached drawings.

Embodiment 1

Figure 3:
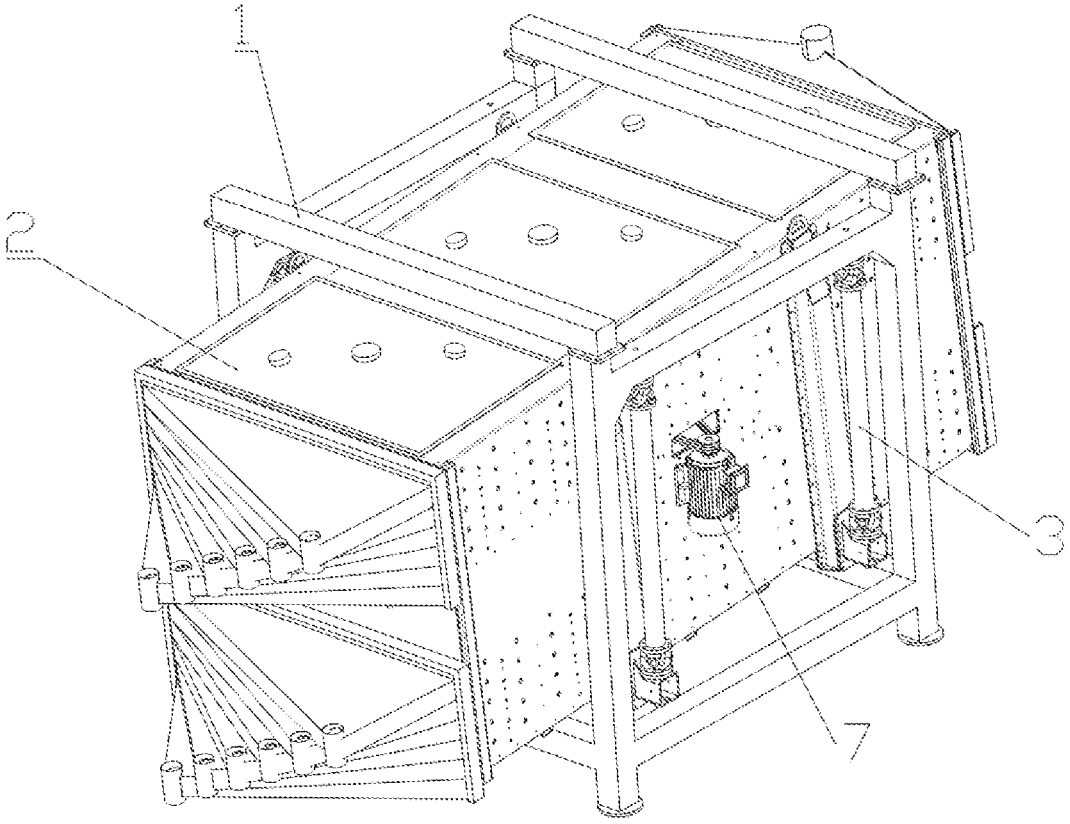
FIG. 3 is a structural schematic view of the vibration exciter provided on the middle end of a double vibration source square oscillating sieve in the invention.
Figure 4:
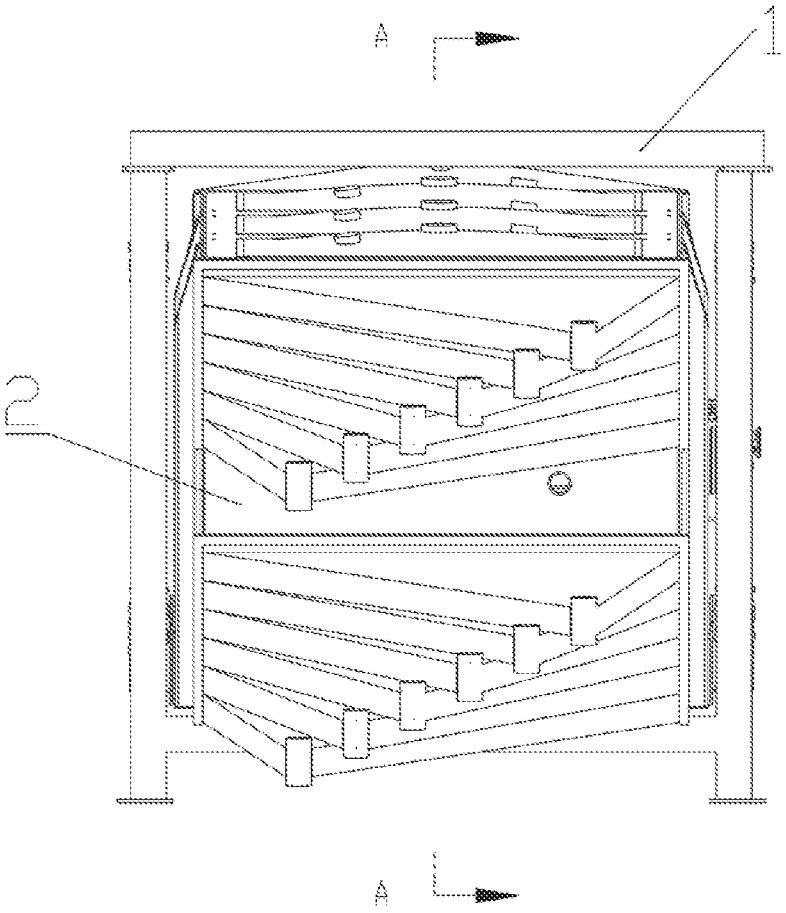
FIG. 4 is a left view of a double vibration source square oscillating sieve in the invention.
Figure 5:
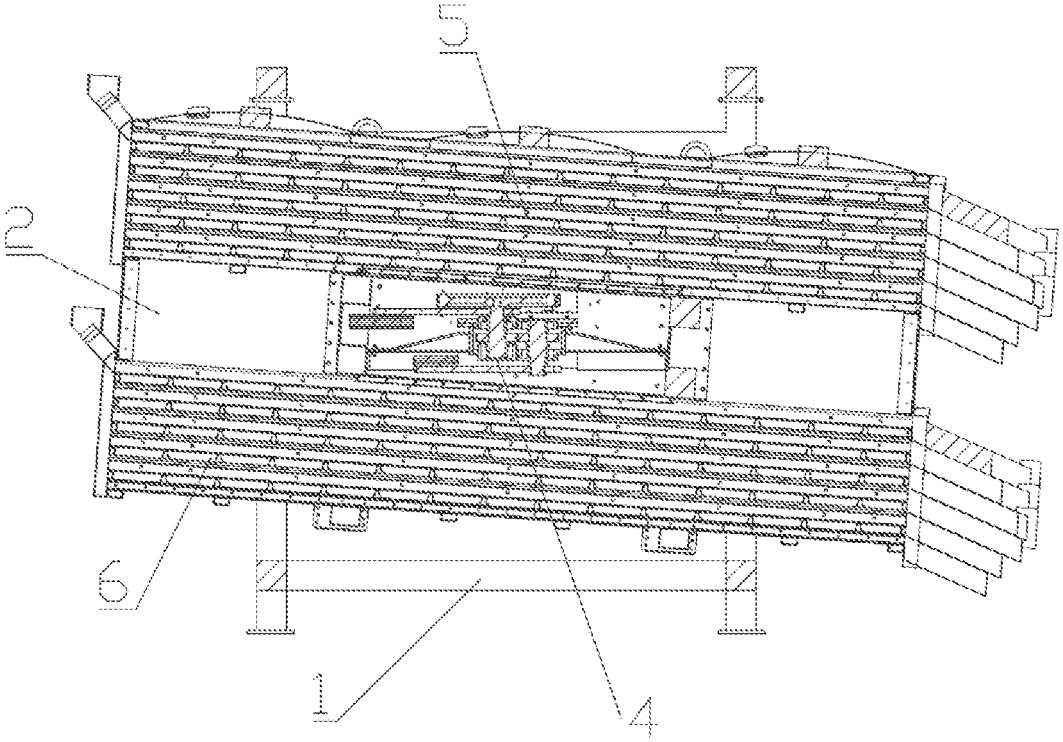
FIG. 5 is a sectional view of A-A in FIG. 4.

As shown in the attached drawings, a double vibration source square oscillating sieve, comprising a support frame 1, a sieve body 2, connecting rods 3 and a vibration exciter 4;

the sieve body 2 is slantwise provided in the support frame 1, the front side and back side of the sieve body 2 are both provided with the connecting rods 3, and two ends of the connecting rods 3 are connected with the top of the support frame 1 and the bottom of the sieve body 2 by a cross universal joint, which can realize the mutual rotation among the sieve body 2, the connecting rods 3 and the support frame 1;

as shown in FIG. 3 and FIG. 5, the vibration exciter 4 is fixedly provided on the middle part of the sieve body 2, and the middle part is the middle part of sieve body 2, the interior upper part of the sieve body 2 is provided with screen assemblies I 5, and the interior lower part of the sieve body 2 is provided with screen assemblies II 6, a kind of material can be sieved simultaneously through the screen assemblies I 5 and the screen assemblies II 6, and two different materials can be separated and sieved simultaneously through the screen assemblies I 5 and the screen assemblies II 6, which increases utilization efficiency of the oscillating sieve; the vibration exciter 4 is provided between the screen assemblies I 5 and the screen assemblies II 6, and the sieve body 2 is provided with the motor 7 connected with the vibration exciter 4 by the belt.

Further, the number of the screen assemblies I 5 is not less than 2, and the number of the screen assemblies I 5 and the screen assemblies II 6 is equal.

Figure 6:
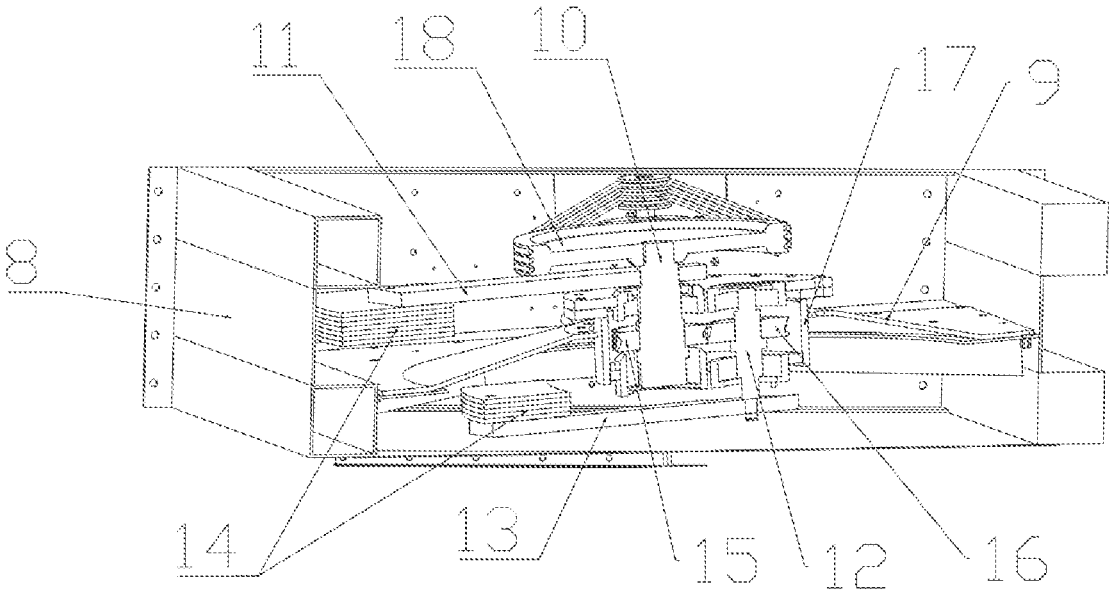
FIG. 6 is an internal structural schematic view of the vibration exciter part of a double vibration source square oscillating sieve in the invention.

As shown in FIG. 5 to FIG. 6, the vibration exciter 4 comprises a fixed housing 8, a gear portion, first vibration excitation assemblies and second vibration excitation assemblies which are connected with the gear portion, and the fixed housing 8 is fixedly connected between the screen assemblies I 5 and the screen assemblies II 6, the fixed housing 8 is provided with a fixed disk 9 which is connected with the gear portion, and the fixed disk 9 can fix the vibration exciter 4 in the fixed housing 8, the gear portion is used to drive the first vibration excitation assemblies and the second vibration excitation assemblies to rotate synchronously and reversely.

Figure 7:
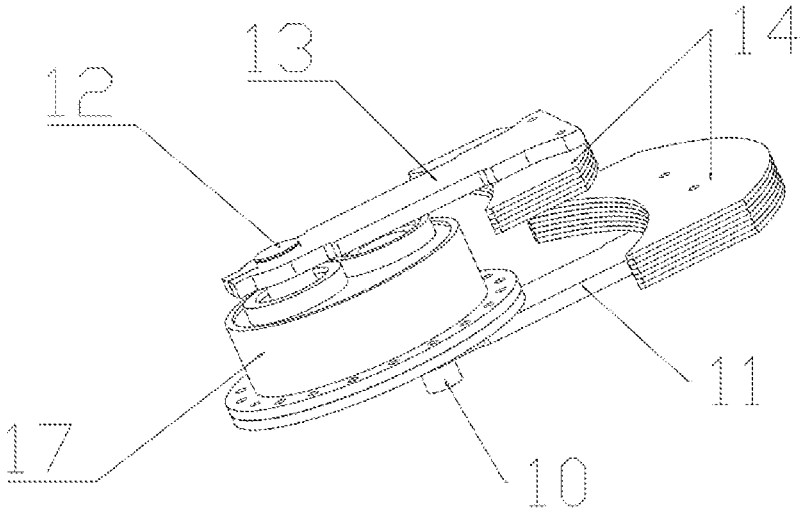
FIG. 7 is a structural schematic view of the vibration exciter of a double vibration source square oscillating sieve in the invention.
Figure 8:
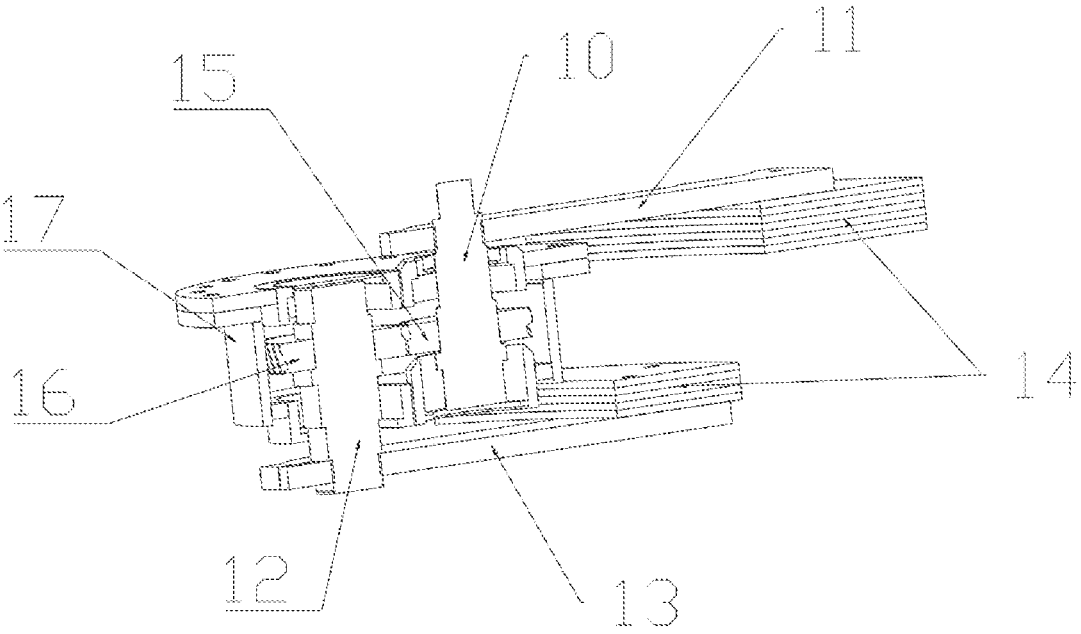
FIG. 8 is an internal structural schematic view of the vibration exciter of a double vibration source square oscillating sieve in the invention.

As shown in FIG. 7 to FIG. 8, the first vibration excitation assemblies comprise a first rotating shaft 10 and a first flail block 11 only connected with one end of the first rotating shaft 10, and particularly, the first flail block 11 can be one or more. When the first flail block 11 is one, the first flail block 11 is vertically connected with the upper end of the first rotating shaft 10, which can synchronously rotate with the first rotating shaft 10. When the first flail block 11 is more, the multiple first flail blocks 11 are vertically connected with the upper end of the first rotating shaft 10, the multiple first flail blocks 11 are eccentrically distributed relative to the first rotating shaft 10, and the first flail blocks 11 can synchronously rotate with the first rotating shaft 10.

The second vibration excitation assemblies comprise a second rotating shaft 12 and a second flail block 13 only connected with the end of the second rotating shaft 12 which is away from the first flail block 11, and particularly, the second flail block 13 can be one or more. When the second flail block 13 is one, the second flail block 13 is vertically connected with the lower end of the second rotating shaft 12, which can synchronously rotate with the second rotating shaft 12. When the second flail block 13 is more, the multiple second flail blocks 13 are vertically connected with the lower end of the second rotating shaft 12, the multiple second flail blocks 13 are eccentrically distributed relative to the second rotating shaft 12, and the second flail blocks 13 can synchronously rotate with the second rotating shaft 12.

Clump weights 14 are provided on both the first flail block 11 and the second flail block 13, to ensure that the vibration exciter 4 possesses enough vibration excitation force. Particularly, the clump weights 14 can be multiple of the same mass or of different mass, and by choosing the clump weights 14 of different mass or quantity, the gross mass of the clump weights connected with the first flail block 11 and the second flail block 13 is different, so strength of the vibration excitation force can be adjusted through the clump weights 14 of different gross mass. Then, the sum of the vibration excitation force of the first flail block 11 and the second flail block 13 controls the forward and backward movement force of the square oscillating sieve, and the difference of the vibration excitation force of the first flail block 11 and the second flail block 13 controls the left and right movement force of the square oscillating sieve.

In the embodiment, the clump weights 14 are provided on the ends of the two flail blocks which are away from the corresponding rotating shafts, and the eccentric distance can be adjusted by providing the flail blocks with different length.

The rotating shaft 10 and the second shaft 12 are parallel, and certain clearance is provided between the two, to ensure that the rotation of the two is not affected by each other.

The gear portion comprises a first gear 15 and a second gear 16. The first gear 15 is sleeved on the first rotating shaft 10, which can drive the first rotating shaft 10 to rotate simultaneously; the second gear 16 is sleeved on the second rotating shaft 12, which can drive the second rotating shaft 12 to rotate simultaneously; the first gear 15 is meshed with the second gear 16. Gear meshing rotation hold features of large application scope, high transmission efficiency, long working life, smooth and steady transmission, high reliability, constant instantaneous transmission ratio, two shaft transmission which can meet the relative synchronization requirement of various positions, etc.

The gear portion also comprises a gear case 17, the first gear 15 and the second gear 16 are both provided in the gear case 17. Particularly, the lower end of the first rotating shaft 10 is connected with the bottom of the gear case 17 by bearing assemblies, the gear case 17 extends from the upper end of the first rotating shaft 10, and the bearing assemblies are provided on the part which the gear case 17 extends from; the upper end of the second rotating shaft 12 is connected with the top of the gear case 17 by bearing assemblies, the gear case 17 extends from the lower end of the second rotating shaft 12, and the bearing assemblies are provided on the part which the gear case 17 extends from. The fixed disk 9 is fixedly connected with the outside of the gear case 17.

Further, the gear case 17 extends from one end of the first rotating shaft 10 which is away from the second flail block 13, the end of the first rotating shaft 10, which the gear case 17 extends from, is provided with a pulley 18, and the pulley 18 is connected with the motor 7 by the belt.

In the use of a double vibration source vibration exciter in the embodiment, the first vibration excitation assemblies and the second vibration excitation assemblies are driven by the motor 7 to realize the synchronous and reverse rotation, and further the first flail block 11 and the second flail block 13 are respectively driven by the first rotating shaft 10 and the second rotating shaft 12 to realize the synchronous and reverse rotation, the first flail block 11 and the second flail block 13 generate the vibration excitation force in their respective directions, and because the gross mass of the clump weights 14 on the first flail block 11 and the second flail block 13 is different, the gross vibration excitation force will become smaller when the two vibration excitation forces of different directions partly counteract each other and the gross vibration excitation force will become bigger when the two vibration excitation forces of the same direction superpose each other, and the difference exists in the vibration excitation force of various directions in a rotation period, so that the device which is excited to vibrate no longer performs the circular and swirling movement. The first rotating shaft 10 and the second rotating shaft 12 are provided with flail blocks at the ends which are away from each other, and the flail block length can be extended infinitely, which is no longer limited by the distance between the first rotating shaft 10 and the second rotating shaft 12. In the meantime, the first flail block 11 and the second flail block 13 are respectively provided on both sides of the gear portion, so that force exerted on the gear portion is uniform, which rationally utilizes space and extends service life.

When the material enters into the sieve body 2 and touches the screen, with the different vibration excitation force of the vibration exciter 4 in various directions, the oscillating direction and the oscillating amplitude of the oscillating sieve are also different, so that the material on the screen is no longer the circular and spiral moving trajectory, and the spiral trajectory is extended on the movement direction of the material, so that the material which is close to screen holes possesses a relatively short time to stay on the screen, then the material passively performs the forward and backward movement, to produce sieving characteristics of the reciprocating sieve, so that the material which is close to screen holes can be smoothly sieved out and further the material can pass through the screen holes more easily with the different moving trajectories, which increases the sieving precision, the overall production, the production efficiency and the elastic force of cleaning screen to facilitate the screen cleaning.

Embodiment 2

Figure 1:
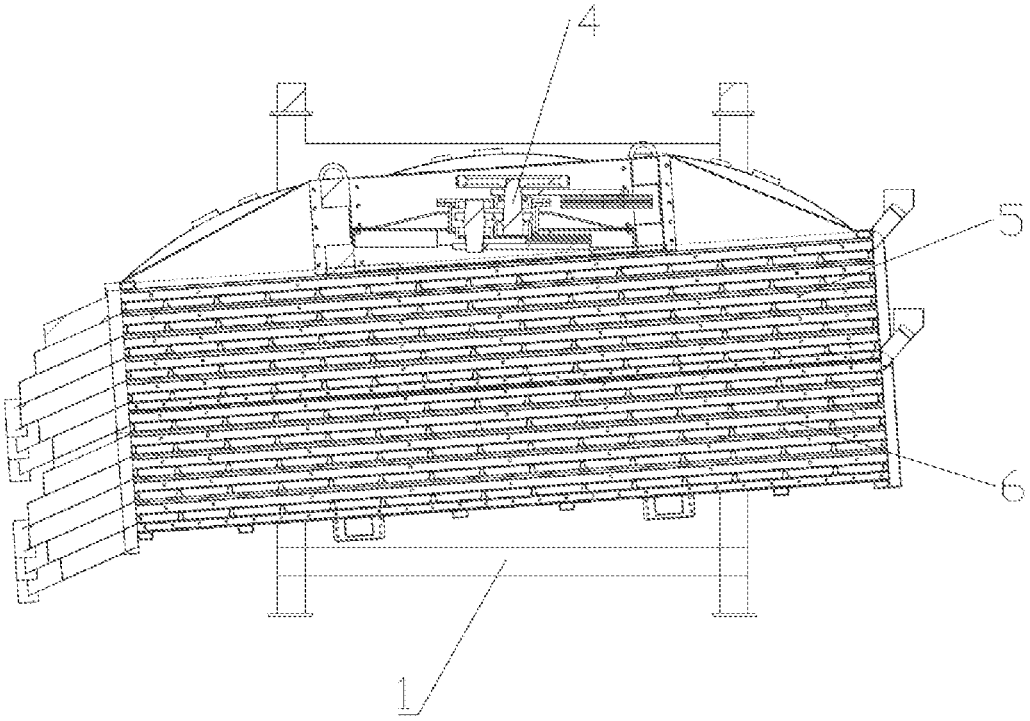
FIG. 1 is a structural schematic view of the vibration exciter provided on the upper end of a double vibration source square oscillating sieve in the invention.

In combination with FIG. 1, the vibration exciter 4 is fixedly provided on the upper part of the sieve body 2, the vibration exciter 4 is provided on the upper side of the screen assemblies I 5, and the sieve body 2 is provided with the motor 7 connected with the vibration exciter 4 by the belt.

Embodiment 3

Figure 2:
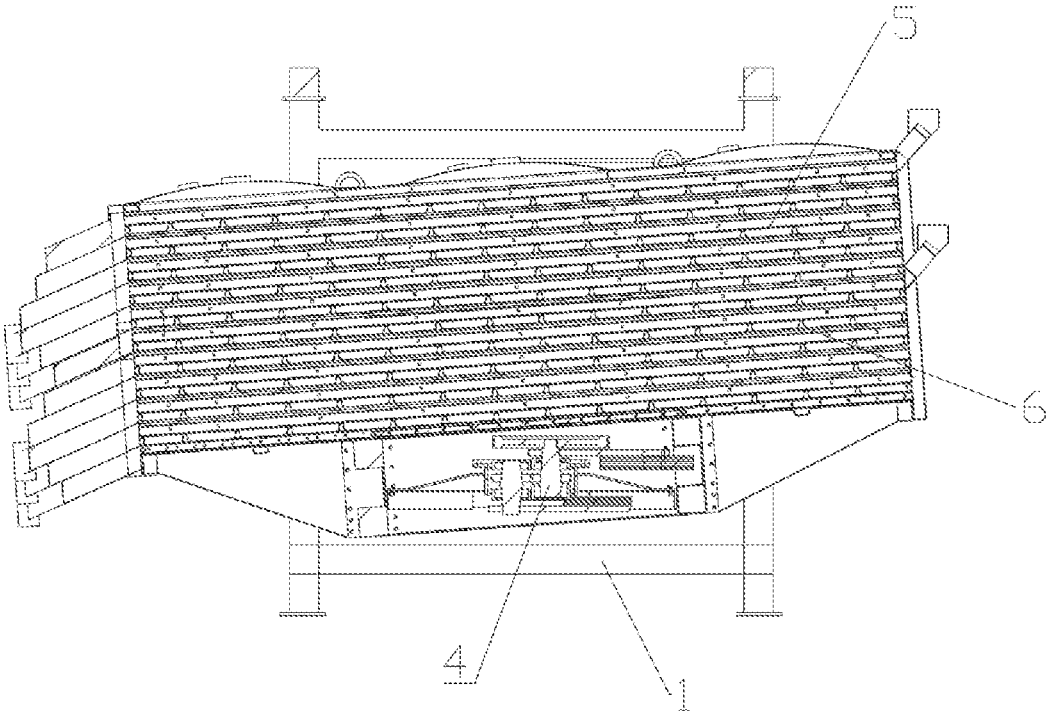
FIG. 2 is a structural schematic view of the vibration exciter provided on the lower part of a double vibration source square oscillating sieve in the invention.

In combination with FIG. 2, the vibration exciter 4 is fixedly provided on the lower part of the sieve body 2, the vibration exciter 4 is provided on the lower side of the screen assemblies II 6, and the sieve body 2 is provided with the motor 7 connected with the vibration exciter 4 by the belt.

The invention claimed is:

1. A double vibration source square oscillating sieve, comprising a support frame, a sieve body, connecting rods and a vibration exciter, wherein the sieve body is slantwise provided in the support frame, a front side and a back side of the sieve body are both provided with the connecting rods, and two ends of the connecting rods are connected with the upper part of the support frame and the lower part of the sieve body;

the vibration exciter is fixedly provided on any position of the upper end, the lower end and the middle part of the sieve body, and the sieve body is provided with a motor which is connected with the vibration exciter by a belt;

the vibration exciter comprises a fixed housing, a gear portion, first vibration excitation assemblies and second vibration excitation assemblies which are connected with the gear portion, and the fixed housing is fixedly connected with the sieve body, the fixed housing is provided with a fixed disk which is connected with the gear portion, and the gear portion is used to drive the first vibration excitation assemblies and the second vibration excitation assemblies to rotate synchronously and reversely;

the first vibration excitation assemblies comprise a first rotating shaft, and the second vibration excitation assemblies comprise a second rotating shaft; and the first rotating shaft and the second rotating shaft are parallel with and offset from each other along an axial direction of the first rotating shaft and the second rotating shaft.

2. The double vibration source square oscillating sieve according to claim 1, wherein the first vibration excitation assemblies further comprise a first flail block only connected with a first end of the first rotating shaft, the second vibration excitation assemblies further comprise a second flail block only connected with a first end of the second rotating shaft which is away from the first end of the first flail block, and clump weights are provided on both the first flail block and the second flail block.

3. The double vibration source square oscillating sieve according to claim 2, wherein the first rotating shaft and the second rotating shaft are provided with clearance.

4. The double vibration source square oscillating sieve according to claim 2, wherein rotating axes of the first rotating shaft and the second rotating shaft are both provided vertically.

5. The double vibration source square oscillating sieve according to claim 2, wherein the gear portion comprises a first gear sleeved on the first rotating shaft and a second gear sleeved on the second rotating shaft, and the second gear is meshed with the first gear.

6. The double vibration source square oscillating sieve according to claim 2, wherein the gear portion also comprises a gear case, the first rotating shaft and the second rotating shaft both penetrate the gear case and they are connected with the gear case, and the fixed disk is fixedly connected with the outside of the gear case.

7. The double vibration source square oscillating sieve according to claim 2, wherein one end of the first rotating shaft which is away from the second flail block is provided with a pulley, and the pulley is connected with the motor by the belt.

8. The double vibration source square oscillating sieve according to claim 2, wherein the first flail block rotates in a first plane and the second flail block rotates in a second plane, and the first plane and second plane are offset from each other in the axial direction of the first rotating shaft and the second rotating shaft.

9. The double vibration source square oscillating sieve according to claim 2, wherein the first flail block rotates over a second end of the second shaft, and the second flail block rotates over a second end of the first shaft.

10. The double vibration source square oscillating sieve according to claim 1, wherein the interior upper part of the sieve body is provided with screen assemblies I, and the interior lower part of the sieve body is provided with screen assemblies II, the number of the screen assemblies I is not less than 2, and the number of the screen assemblies I and the screen assemblies II is equal.

* * * * *